US009986808B2

(12) United States Patent
Halpern

(10) Patent No.: US 9,986,808 B2
(45) Date of Patent: Jun. 5, 2018

(54) LOCKING DRAWSTRING BAG

(71) Applicant: Donald Mitchell Halpern, New Albany, OH (US)

(72) Inventor: Donald Mitchell Halpern, New Albany, OH (US)

( * ) Notice: Subject to any disclaimer, the term of this patent is extended or adjusted under 35 U.S.C. 154(b) by 261 days.

(21) Appl. No.: 15/175,521

(22) Filed: Jun. 7, 2016

(65) Prior Publication Data

US 2016/0353850 A1 Dec. 8, 2016

Related U.S. Application Data

(60) Provisional application No. 62/172,283, filed on Jun. 8, 2015.

(51) Int. Cl.

| | |
|---|---|
| ***A45F 4/02*** | (2006.01) |
| ***A45C 13/20*** | (2006.01) |
| ***A45C 13/10*** | (2006.01) |

(52) U.S. Cl.

CPC ..... *A45C 13/20* (2013.01); *A45C 13/1046* (2013.01)

(58) Field of Classification Search

CPC ..... A45C 3/06; A45C 13/04; A45C 13/06; A45C 13/10; A45C 1/02; Y10T 24/318

USPC ..... 150/101, 103, 107, 134; 206/315.4, 206/315.6; 224/153, 160, 581, 604; 70/14, 18, 58

See application file for complete search history.

(56) References Cited

U.S. PATENT DOCUMENTS

| | | | | |
|---|---|---|---|---|
| 1,201,972 | A | 10/1916 | Kelly | |
| 2,569,076 | A | 9/1951 | Schaye | |
| 3,590,608 | A | 7/1971 | Smyth et al. | |
| 4,046,312 | A | 9/1977 | Krizan | |
| 4,066,195 | A | 1/1978 | Dickler | |
| 4,213,314 | A | 7/1980 | Trader | |
| 4,805,426 | A | 2/1989 | Dimmick et al. | |
| 4,817,403 | A | 4/1989 | Dimmick | |
| 4,885,920 | A | 12/1989 | Larson | |
| 6,026,662 | A | 2/2000 | Schlipper | |
| 6,244,081 | B1 | 6/2001 | Schlipper | |
| 6,435,391 | B1 * | 8/2002 | Vazquez | A45C 13/1046 224/613 |
| 7,059,371 | B2 | 6/2006 | Renn | |
| 7,069,753 | B2 | 7/2006 | Schlipper | |
| 7,635,089 | B2 | 12/2009 | Augustinowicz et al. | |
| D619,875 | S | 7/2010 | McCauley | |
| 7,889,056 | B2 | 2/2011 | Home | |
| 8,308,125 | B2 | 11/2012 | Losaw | |
| 8,499,804 | B2 | 8/2013 | Schulte | |
| 8,528,371 | B2 | 9/2013 | Spiegel et al. | |
| 8,578,982 | B2 | 11/2013 | Lee et al. | |
| 8,910,679 | B2 | 12/2014 | Avganim | |
| 8,925,181 | B2 | 1/2015 | Godshaw et al. | |
| D765,971 | S * | 9/2016 | Waters | D3/256 |
| 2003/0110818 | A1 * | 6/2003 | Schlipper | A45C 13/1046 70/18 |
| 2005/0056674 | A1 * | 3/2005 | Renn | A45C 3/06 224/625 |
| 2007/0240798 | A1 | 10/2007 | Bihler | |

(Continued)

*Primary Examiner* — Fenn C Mathew
*Assistant Examiner* — Cynthia Collado
(74) *Attorney, Agent, or Firm* — Calfee, Halter & Griswold LLP

(57) ABSTRACT

An improved tote bag with a locking mechanism is disclosed. The bag provides a high degree of security yet still remains soft, unstructured, and fashionable.

20 Claims, 10 Drawing Sheets

(56) References Cited

U.S. PATENT DOCUMENTS

| | | | | |
|---|---|---|---|---|
| 2007/0289775 | A1 | 12/2007 | Potts et al. | |
| 2008/0128058 | A1 | 6/2008 | Bodine | |
| 2009/0226050 | A1 | 9/2009 | Hughes | |
| 2009/0260731 | A1 | 10/2009 | Roth et al. | |
| 2010/0027921 | A1 | 2/2010 | Thomson et al. | |
| 2010/0243114 | A1 | 9/2010 | Hai et al. | |
| 2010/0282381 | A1* | 11/2010 | Badertscher | E05B 73/0005 150/159 |
| 2011/0072862 | A1 | 3/2011 | Avganim et al. | |
| 2012/0267017 | A1* | 10/2012 | Sloan | A45C 3/06 150/103 |
| 2013/0048691 | A1* | 2/2013 | Meyer | A45C 13/1046 224/579 |
| 2013/0051709 | A1* | 2/2013 | Roether | A43B 23/024 383/75 |
| 2013/0221049 | A1* | 8/2013 | Giard | A45F 3/04 224/604 |
| 2014/0008166 | A1* | 1/2014 | Machuca | A45C 3/00 190/112 |
| 2014/0150219 | A1* | 6/2014 | Burggren | B65D 33/1658 24/592.11 |
| 2015/0035306 | A1 | 2/2015 | Ewing | |
| 2015/0173491 | A1* | 6/2015 | Lesch | A45F 3/04 224/656 |
| 2016/0015584 | A1* | 1/2016 | Choudhury | A61G 7/1023 5/81.1 R |

* cited by examiner

LOCKING DRAWSTRING BAG

RELATED APPLICATIONS

The present application is being filed as a non-provisional patent application claiming priority under 35 U.S.C. § 119(e) from, and any other benefit of, U.S. Provisional Patent Application No. 62/172,283 filed on Jun. 8, 2015, the entire disclosure of which is herein incorporated by reference.

FIELD

The invention generally relates to handbags, shoulder bags, sack packs, and tote bags and, more particularly, to bags designed to prevent theft by enabling the contents to be locked inside and the bag to be locked to a fixed object.

BACKGROUND

Bags of all types have been used by people to carry their belongings for thousands of years. Over the years, bags have taken on a seemingly infinite number of shapes, sizes, and styles. Bags are designed for style/fashion, comfort, and utility (durability and the ability to hold and protect objects). Typically, bags are made out of a textile that enables them to be attractive, flexible, durable, pleasant to the touch, and functionally able to adapt to a wide range of contents. Some bags are made so that they can be closed to prevent the contents from falling out, and some bags can be locked closed to prevent tampering with the contents.

Furthermore, it is known that even bags that lock closed do not truly protect the contents from tampering, as the textile construction leaves them susceptible to being cut or torn open by someone wishing to tamper with the contents. This vulnerability causes undesirable conditions for the user including but not limited to: a false sense of security for some users; ongoing concern over tampering or theft since the contents are really not secure; damage to the bag if tampering or theft is attempted; and reduced utility for the bag since it is not secure due to its construction, even though it locks.

Furthermore, bags that lock are typically constructed of a heavy woven canvas or nylon textile that is very stiff, rough, and abrasive, and not considered to be fashionable or comfortable to carry. For those reasons, locking bags have traditionally been limited to business and security uses, and not everyday consumer and fashion use.

Furthermore, even bags that lock closed are vulnerable to theft, as some thieves may choose to take the entire bag rather than just forcibly open it to access its contents. Therefore, even the most secure bag made from the most impenetrable material and locking mechanism still leaves the contents vulnerable to theft.

SUMMARY

In view of the above, a bag is provided that is made from a textile that is highly resistant to cutting, tearing, or abrasion. The material is extremely difficult to penetrate by thieves. This design reduces the risk of a thief easily "breaking in" through the bag to access its contents. Additionally, the textile is soft, flexible, attractive, and is considered highly desirable by consumers from a fashion and comfort standpoint.

The bag also uses a novel strap, which can be used both to lock the bag closed and to secure the bag to a fixed object.

The strap is made from a tubular textile material that is soft to the touch and has a high degree of tensile strength. Inside the tubular strap is an assembly made from wire rope (braided steel cable). The combination of the tubular textile surrounding the wire rope creates a strap that is soft, flexible, attractive, and resistant to cutting, stretching, or breaking.

The bag also uses a novel compartment to hide the strap. This compartment keeps the bag aesthetically pleasing by hiding the strap such that it is not visible when it is not being used to lock or secure the bag.

BRIEF DESCRIPTION OF THE DRAWINGS

The general inventive concepts, as well as embodiments and advantages thereof, are described below in greater detail, by way of example, with reference to the drawings in which.

DETAILED DESCRIPTION

Figure 1:
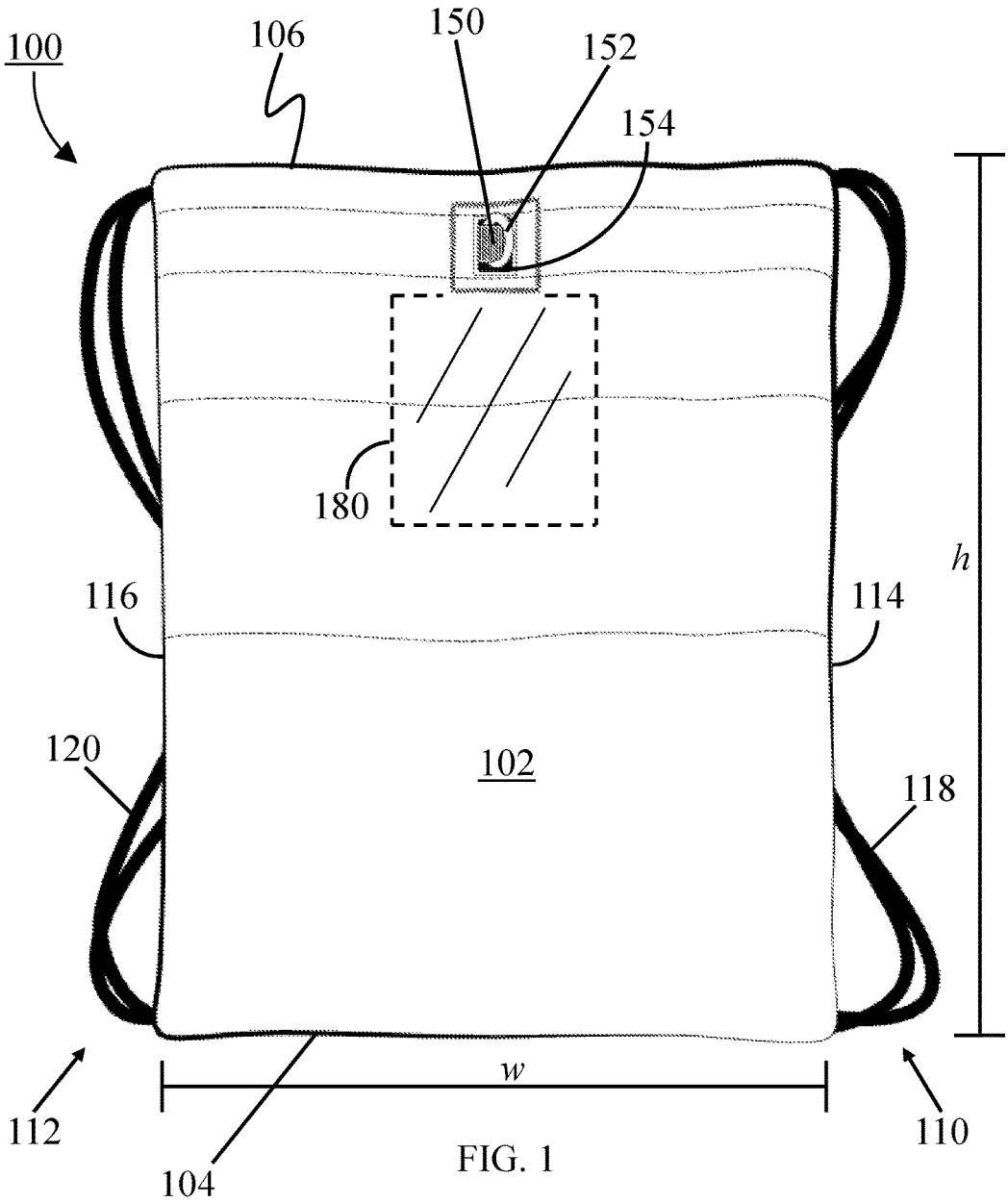
FIG. 1 is a front elevational view of a locking bag, according to an exemplary embodiment.

While the general inventive concepts are susceptible of embodiment in many different forms, there are shown in the drawings, and will be described herein in detail, specific embodiments thereof with the understanding that the present disclosure is to be considered merely as an exemplification of the general inventive concepts. Accordingly, the general inventive concepts are not intended to be limited to the specific embodiments illustrated herein.

A locking, cut-resistant bag 100, according to an exemplary embodiment, will be described with reference to FIGS. 1-10. The bag 100 is formed from a material that exhibits superior cut, tear, and abrasion resistance as compared to conventional materials used to make such bags (e.g., handbags, shoulder bags, sack packs, tote bags). In some embodiments, the cut-resistant fabric is the Cut-Tex® PRO material provided by the PPSS Group (United Kingdom). Cut-Tex® PRO is a cut-resistant fabric made out of a combination of ultra-high molecular weight polyethylene (UHMWPE) and other fibers weaved by special high-density knitting machines. The Cut-Tex® PRO material is generally five (5) times more cut resistant than Kevlar®, a material known for its use in bulletproof vests. The Cut-Tex® PRO material meets other current standards, as shown in Table 1.

TABLE 1

| | |
|---|---|
| ISO 13997: 1999 Blade Cut Resistance Level 5 | >27 Newton |
| EN 388: 2003 Blade Cut Resistance Level 5 | Highest level |
| EN 388: 2003 Tear Resistance Level 4 | >398 Newton |
| EN 388: 2003 Abrasion Resistance Level 4 | >8,000 cycles |

In general, the material is not readily compromised by traditional cutting implements such as scissors, knives, etc. Instead, cutting of the material may require specialized equipment such as a rotary cutting machine, a CNC router, etc. In some embodiments, the material used to form the bag 100 may have other properties, for example, being flame retardant. Typically, the material is relatively supple and has characteristics (e.g., look, feel) that would render it aesthetically pleasing to many users.

The bag 100 can be formed from one or more layers, plies, or the like of the material, which are joined in any suitable manner. In some embodiments, layers of the material are sewn together. In some embodiments, the thread used to sew the material together is also durable and/or cut resistant to avoid introducing a potential "vulnerability" to the bag.

In some embodiments, the material is formed as a tube so that the bag 100 can be fashioned by closing (e.g., sewing) an end of the tube shut. In some embodiments, the end of the tube to be closed is folded inward and then sewn together, whereby the stitching is neither visible nor accessible from outside the bag 100. In this manner, the bag 100 is formed and includes a tubular body 102 extending between a closed end 104 and an open end 106.

The inside of the bag 100 defines a cavity capable of storing items. The dimensions of the cavity are not limited by the general inventive concepts. However, the bag 100 will typically be sized so as to be readily worn on the body of or otherwise carried by a single person. In one exemplary embodiment, the bag 100 has a height h of approximately 18 inches (45.7 centimeters) and a width w of approximately 14 inches (35.6 centimeters). In one exemplary embodiment, the bag 100 weighs approximately 22.25 ounces (630.8 grams).

The bag 100 includes two primary states: an open state and a closed state. In the open state, the cavity is generally accessible through the open end 106 of the bag 100 such that items can be placed into and removed from the bag 100. In the closed state, the cavity is generally not accessible. From the closed state, the bag 100 can also be locked to secure items within the cavity of the bag 100 (see FIG. 5). Furthermore, from the closed state, the bag can also be locked to a fixed object to secure the bag 100 at a specific location (see FIG. 7).

As shown in FIG. 1, the bag 100 is in the open state. The bag 100 includes structure that facilitates transition from this open state to the closed state. For example, the bag 100 includes a first drawstring 110, a second drawstring 112, and a locking strap 150.

The first drawstring 110 is primarily situated on a first side 114 of the bag 100. The first drawstring 110 is formed by a pair of ropes 118 or rope-like members. In some embodiments, the first drawstring 110 is formed from a pair of nylon ropes. An end of each of the ropes 118 is anchored at a point 122 on the bag 100 near the first side 114 and the closed end 104. In some embodiments, an end of each of the ropes 118 is passed through an opening in the bag 100 at the point 122 and then knotted to one another so as to not be removable through the opening. The opposite ends of the ropes 118 are feed through an opening in the bag 100 near the first side 114 and the open end 106 and into a first channel 130, passage, or the like that extends around a circumference of the open end 106 of the bag 100. In particular, one of the ropes 118 extends around one half of the circumference of the open end 106 and the other one of the ropes 118 extends around the other half of the circumference of the open end 106. The ends of the two ropes 118 are fixed to the bag 100 at a point 134 within the first channel 130 near the second side 116.

The second drawstring 112 is primarily situated on a second side 116 of the bag 100. The second drawstring 112 is formed by a pair of ropes 120 or rope-like members. In some embodiments, the second drawstring 112 is formed from a pair of nylon ropes. An end of each of the ropes 120 is anchored at a point 124 on the bag 100 near the second side 116 and the closed end 104. In some embodiments, an end of each of the ropes 120 is passed through an opening in the bag 100 at the point 124 and then knotted to one another so as to not be removable through the opening. The opposite ends of the ropes 120 are feed through an opening in the bag 100 near the second side 116 and the open end 106 and into a second channel 132, passage, or the like that extends around a circumference of the open end 106 of the bag 100. In particular, one of the ropes 120 extends around one half of the circumference of the open end 106 and the other one of the ropes 120 extends around the other half of the circumference of the open end 106. The ends of the two ropes 120 are fixed to the bag 100 at a point 136 within the second channel 132 near the first side 114.

The ropes 118, 120 function as carrying handles, shoulder straps, or the like for the bag 100. Given the aforementioned configuration of the ropes 118, 120, pulling on the first drawstring 110 and/or the second drawstring 112 results in the open end 106 of the bag 100 being mostly cinched closed.

The locking strap 150 is formed by surrounding a reinforcing member 200 (see FIG. 10) with a material that is both strong and aesthetically pleasing. In some embodiments, the material is nylon. In some embodiments, the material used to form the locking strap 150 is the same as the material used to form the bag 100. In some embodiments, a color of the material forming the locking strap 150 is selected to complement a color of the material forming the bag 100.

In some embodiments, the material is a tubular nylon strap that surrounds the reinforcing member 200. The tubular nylon covering provides a soft consistent outer feel, a visually appealing look, a high-degree of tensile strength, and adds to the overall cut resistance of the locking strap 150.

Figure 10:
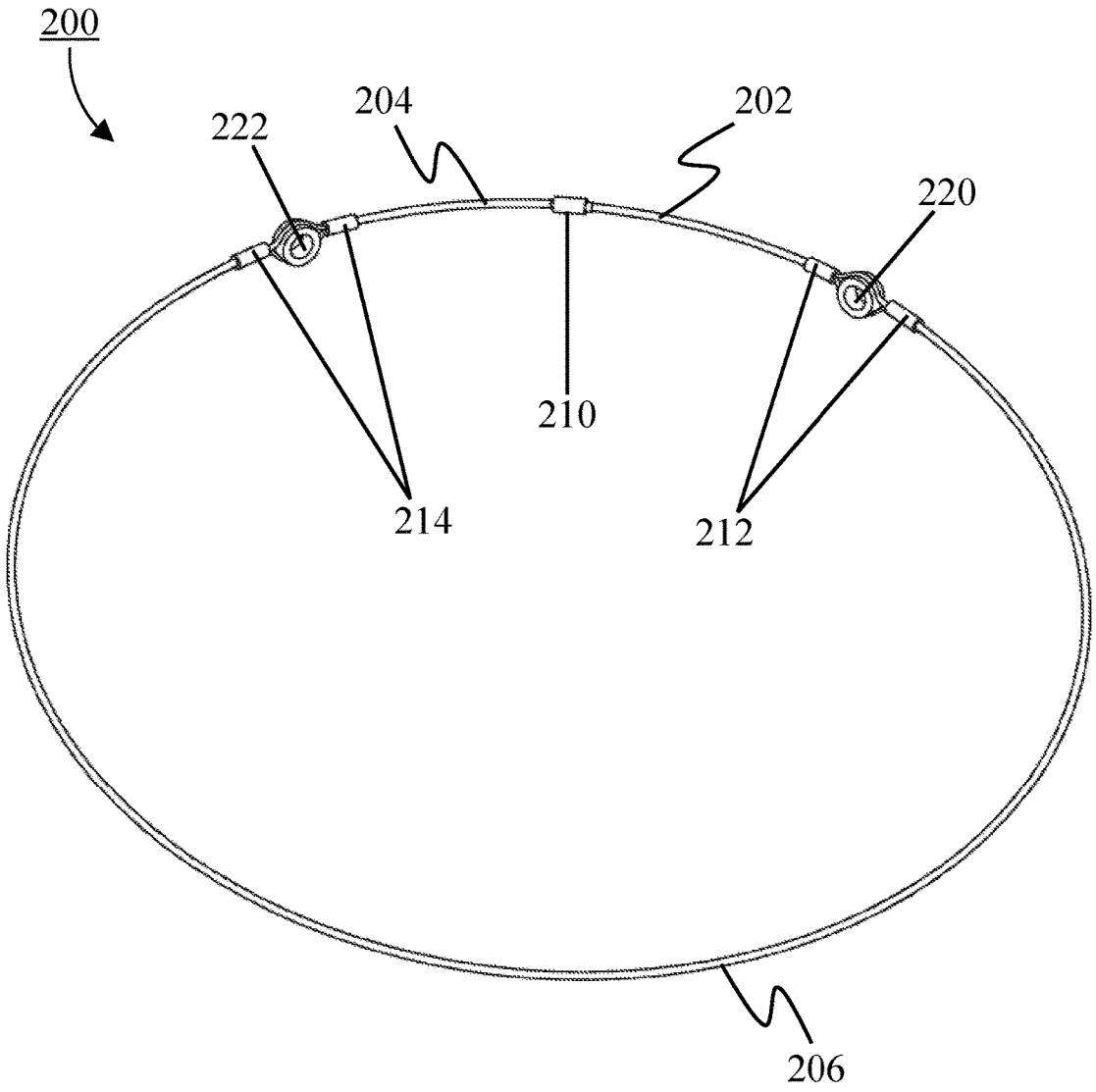
FIG. 10 is a diagram of an internal member of the locking strap of the bag of FIG. 1.

With reference to FIG. 10, the reinforcing member 200 is formed from a material that is highly resistant to cutting, tearing, or abrasion. In some embodiments, the reinforcing member 200 is made from metal cable or wire. In some embodiments, the reinforcing member 200 is made from steel cable.

In one exemplary embodiment, the reinforcing member 200 is made from three pieces 202, 204, 206 of 1/16-inch (0.159-centimeter) stainless steel cable. The general inventive concepts contemplate that thinner or thicker cables could be used. The pieces 202, 204, 206 are joined to one another to form a continuous loop. In particular, as shown in FIG. 10, the pieces 202 and 204 are joined to one another by a fastener 210. The pieces 202 and 206 extend around opposite sides of a spool member 220 and are then joined to one another on both sides of the spool member 220 by a pair of fasteners 212. The fasteners 212 not only secure the pieces 202 and 206 to one another, but also keep the spool member 220 fixed therebetween. In some embodiments, an outer surface of the spool member 220 includes a groove or the like that is sized to accommodate at least a portion of the pieces 202, 206 therein. Likewise, the pieces 204 and 206 extend around opposite sides of a spool member 222 and are then joined to one another on both sides of the spool member 222 by a pair of fasteners 214. The fasteners 214 not only secure the pieces 204 and 206 to one another, but also keep the spool member 222 fixed therebetween. In some embodiments, an outer surface of the spool member 222 includes a groove or the like that is sized to accommodate at least a portion of the pieces 204, 206 therein. In some embodiments, the fasteners 210, 212, 214 are identical.

Notwithstanding the embodiment illustrated in FIG. 10, any type of fastener or other joining technology could be used. For example, in some embodiments, the pieces 202, 204, 206 could be welded to one another.

As noted above, the locking strap 150 is formed by surrounding the reinforcing member 200 with a tubular nylon strap to form a continuous loop. A pair of grommets 160 are positioned in the locking strap 150 to correspond to the spool members 220, 222 of the reinforcing member 200. Often, the grommets 160 will only negligibly increase a thickness of the locking strap 150. Prior to closing the loop, the locking strap 150 is inserted through an opening 154 in the bag 100 and into a third channel 156, passage, or the like that extends around a circumference of the open end 106 of the bag 100. Because it is housed in the third channel 156, most of the locking strap 150 remains hidden from sight when the bag 100 is in the open state, which contributes to the overall aesthetics of the bag 100. The opening 154 in the bag 100 is situated between the first side 114 and the second side 116 (and, preferably, equidistant between the two sides 114, 116). In some embodiments, a portion of the locking strap 150 (such as a portion near fastener 210) is anchored at a point (not shown) within the third channel 156 that is opposite the opening 154.

Prior to closing the loop, the locking strap 150 is also placed through a locking ring 152. In this manner, the locking ring 152 can freely traverse the locking strap 150.

In some embodiments, the first channel 130 and the second channel 132 are the same channel. In this case, the drawstrings 110, 112 can be attached (e.g., stitched) or otherwise anchored within the channel to prevent undesired displacement or unbalancing of the drawstrings 110, 112. In some embodiments, the first channel 130, the second channel 132, and the third channel 156 are all the same channel. In this case, the drawstrings 110, 112 and the locking strap 150 can be attached (e.g., stitched) or otherwise anchored within the channel to prevent undesired displacement or unbalancing of the drawstrings 110, 112 and the locking strap 150. In some embodiments, the third channel 156 is situated below the first channel 130 and the second channel 132 (i.e., furthest from the open end 106 of the bag 100).

Figure 2:
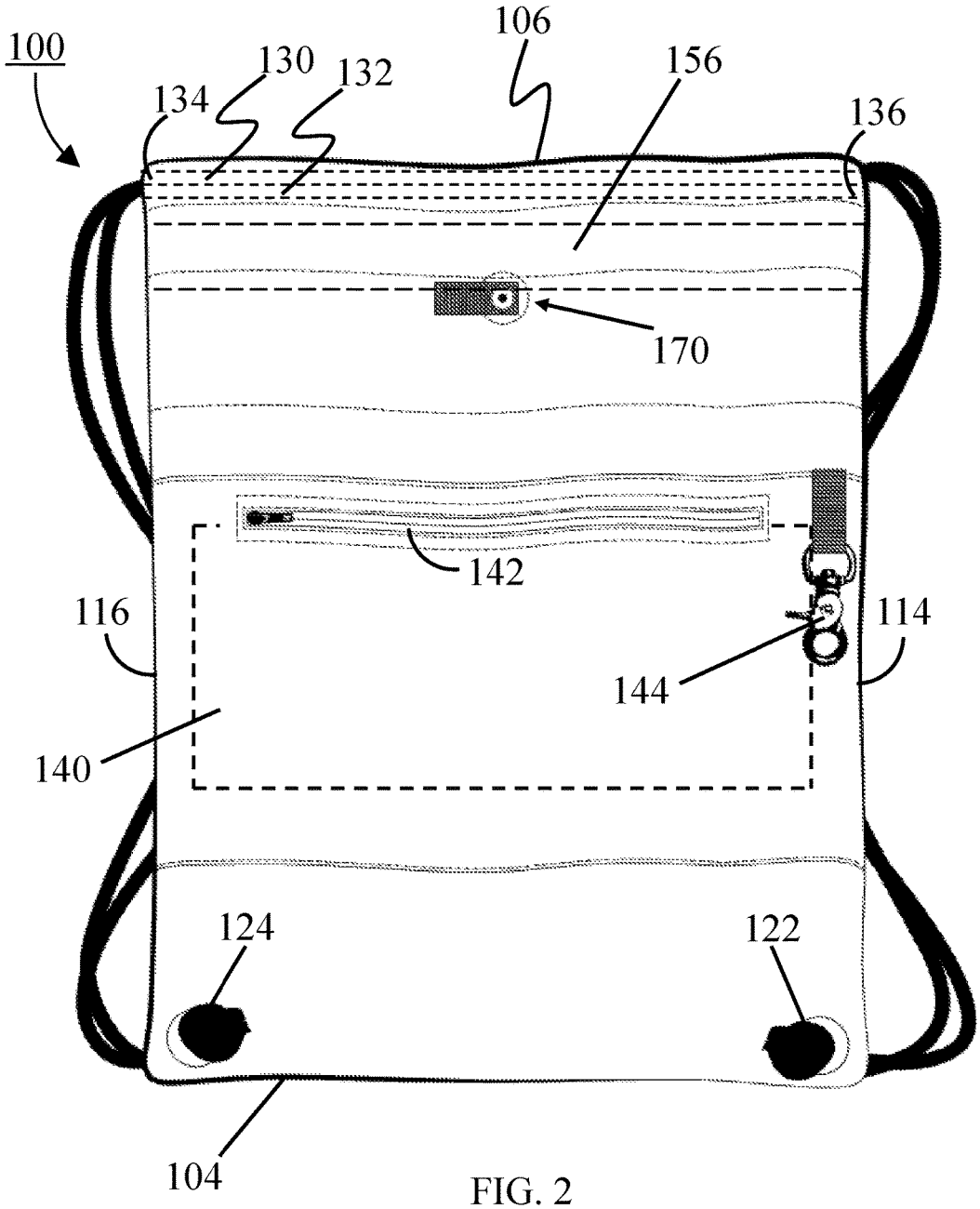
FIG. 2 is a transparent view illustrating internal features of the bag of FIG. 1.
Figure 3:
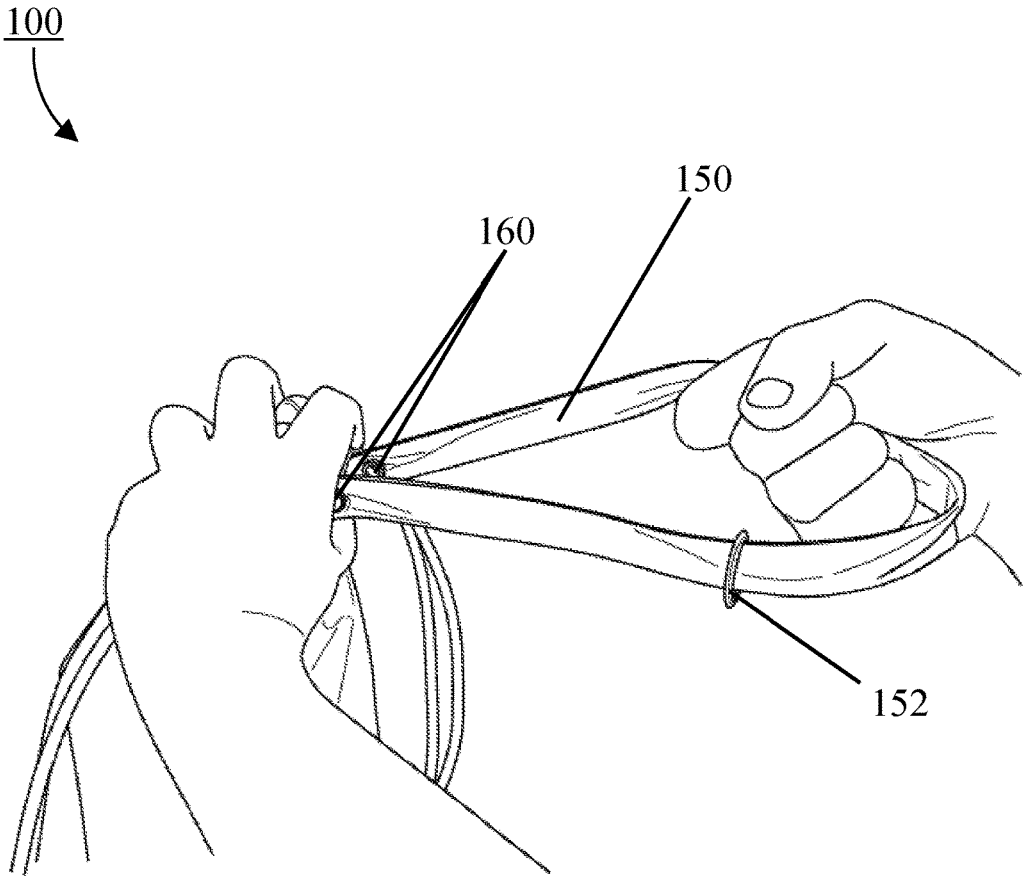
FIG. 3 is a diagram showing manipulation of a locking strap of the bag of FIG. 1.
Figure 4:
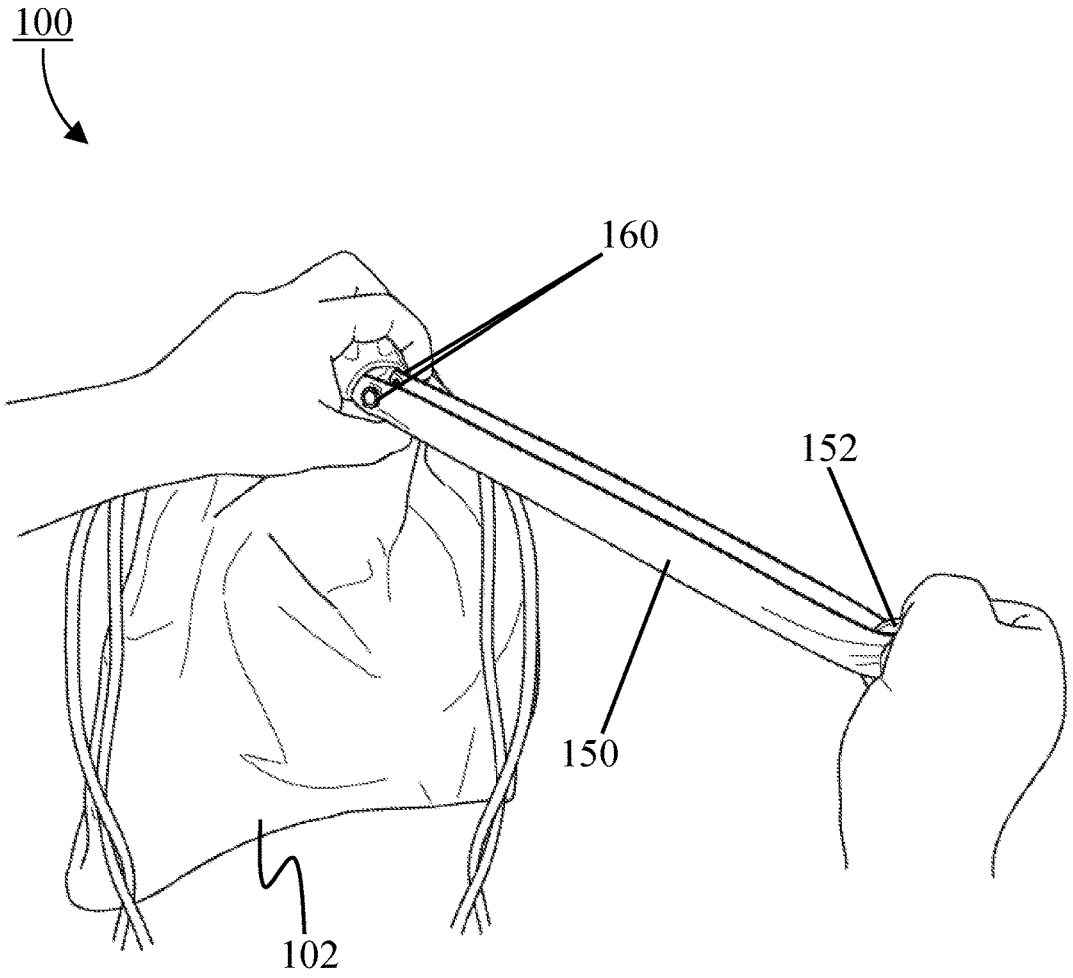
FIG. 4 is another diagram showing manipulation of the locking strap of the bag of FIG. 1.

An interior of the bag 100 (i.e., the cavity formed therein) can include additional structure to increase the storage options available to a user thereof. For example, the bag 100 can include one or more internal storage compartments or devices. As shown in FIG. 2, the bag 100 includes an internal storage pocket 140 having a zipper closure 142. The storage pocket 140 can be made from or otherwise lined with a shielding (e.g., RF shielding) material, which can protect against unauthorized scanning of the contents within the storage pocket 140. As another example, the bag 100 includes a clasp 144 for removably attaching one or more keys thereto. Typically, the grommets 160 are relatively flush with the surface of the locking strap 150.

The interior of the bag 100 can also include structure that increases the security of the bag 100. In particular, the bag 100 can include internal structure that prevents or otherwise increases the difficulty of unauthorized opening of the bag 100. For example, the bag 100 can include structure that is readily opened when the bag 100 is in the open state and virtually impossible to open when the bag 100 is in the closed state.

As one example, the bag 100 can include a unidirectional fastener. As used herein, the term "unidirectional fastener" refers to a snap or other type fastener that can be fastened and unfastened in only one direction. That is, given the four cardinal directions, the unidirectional fastener can be fastened and unfastened by force exerted in a specific one of the directions but not by force exerted in the other three directions. As another example, the bag 100 can include a bidirectional fastener. As used herein, the term "bidirectional fastener" refers to a snap or other type fastener (e.g., zipper) that can be fastened and unfastened through force exerted along one axis but not by force exerted along any other axis.

Figure 8:
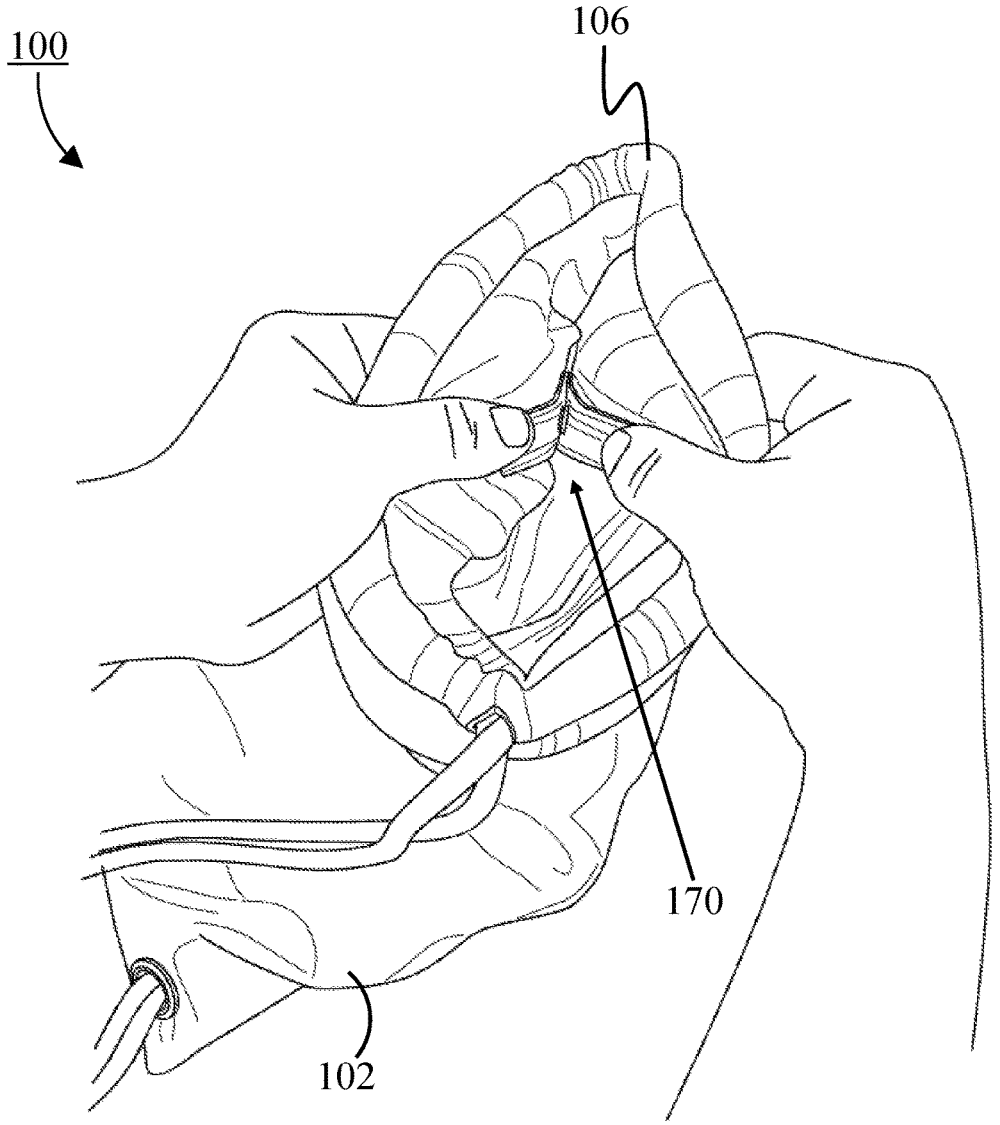
FIG. 8 is a diagram showing a fastening device, according to an exemplary embodiment, in a fastened state within the bag of FIG. 1.
Figure 9:
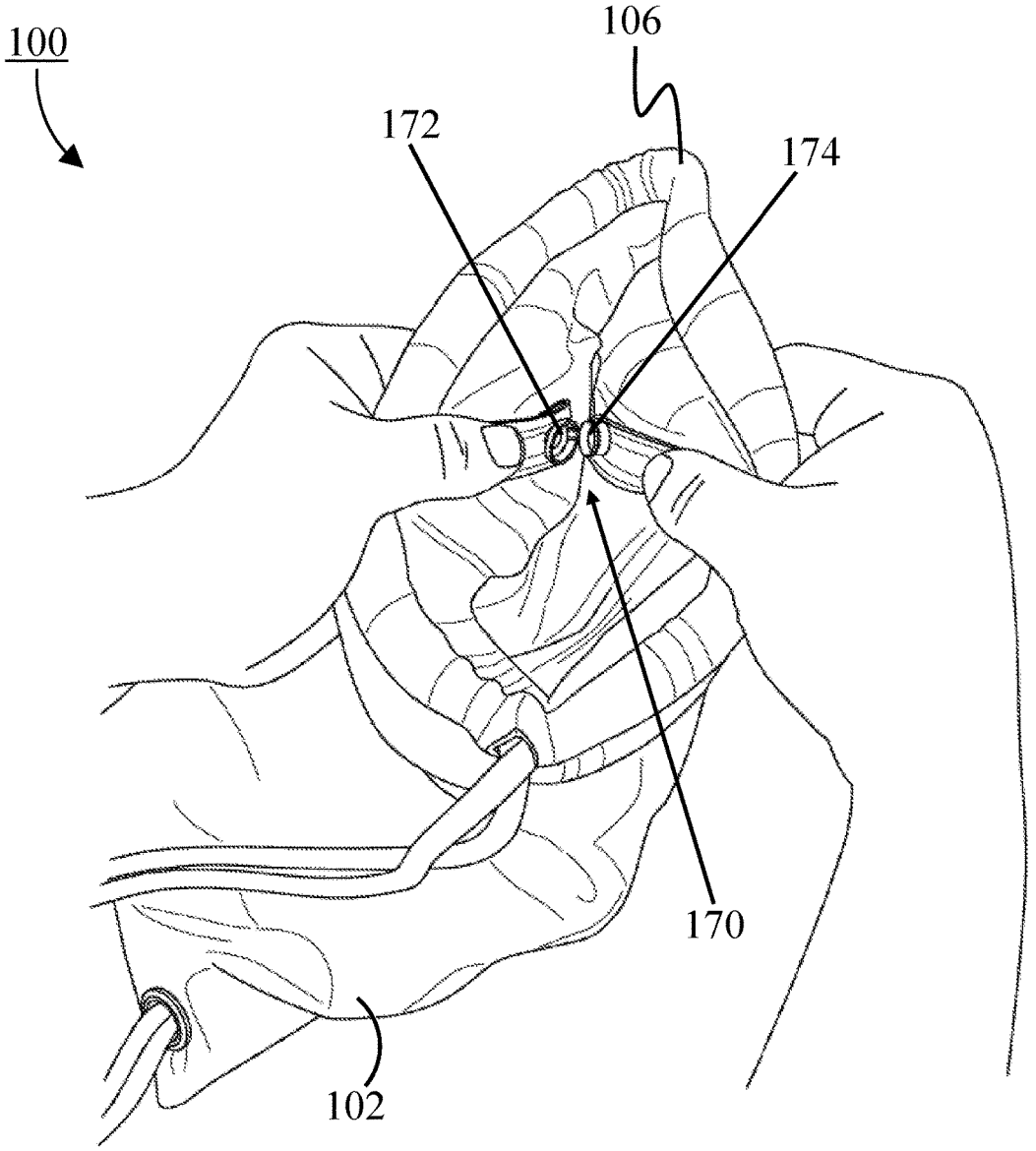
FIG. 9 is a diagram showing a fastening device, according to an exemplary embodiment, in an unfastened state within the bag of FIG. 1.

For example, as shown in FIGS. 8-9, the bag 100 includes an internal unidirectional fastener 170. One such suitable unidirectional fastener is a Pull-the-DOT® snap provided by Scovill Fasteners of Clarkesville, Ga. The unidirectional fastener 170 includes a socket 172 and a stud 174 that can be fastened (see FIG. 8) and unfastened (see FIG. 9) in only one direction, as described above. By choosing the direction in which the unidirectional fastener 170 operates to be substantially parallel to the open end 106 of the bag 100, it is virtually impossible to operate the unidirectional fastener 170 when the bag is in the closed state. Accordingly, the unidirectional fastener 170 provides an additional layer of protection for the contents of the bag 100.

In some embodiments, the bag 100 includes a plurality of unidirectional and/or bidirectional fasteners.

The process of transitioning the bag 100 from the open state to the closed state will now be described.

First, any internal fasteners (e.g., the unidirectional fastener 170) should be fastened.

Next, the first drawstring 110 should be pulled in a direction away from (and preferably substantially perpendicular to) the first side 114 of the bag 100. Simultaneously, the second drawstring 112 should be pulled in a direction away from (and preferably substantially perpendicular to) the second side 116 of the bag 100. By pulling the drawstrings 110, 112 tight, the open end 106 of the bag 100 is cinched closed.

After the open end 106 is cinched closed, the locking strap 150 should be pulled out through the opening 154 in the bag 100. Pulling of the locking strap 150 can be done by pulling on the locking strap 150 itself (see FIG. 3) or by pulling on the locking ring 152 surrounding the locking strap 150 (see FIG. 4). The locking strap 150 should be pulled through the opening 154 until both grommets 160 are outside of the third channel 156 (i.e., are accessible outside of the bag 100). Once the locking strap 150 has been pulled out to this degree, the open end 106 of the bag 100 is considered fully cinched shut.

Next, a locking device 300 is used to lock the bag 100, thereby maintaining the fully cinched shut state of the open end 106 of the bag 100. The locking device 300 can be any conventional lock or similar device capable of being locked and unlocked only by an authorized user.

Figure 5:
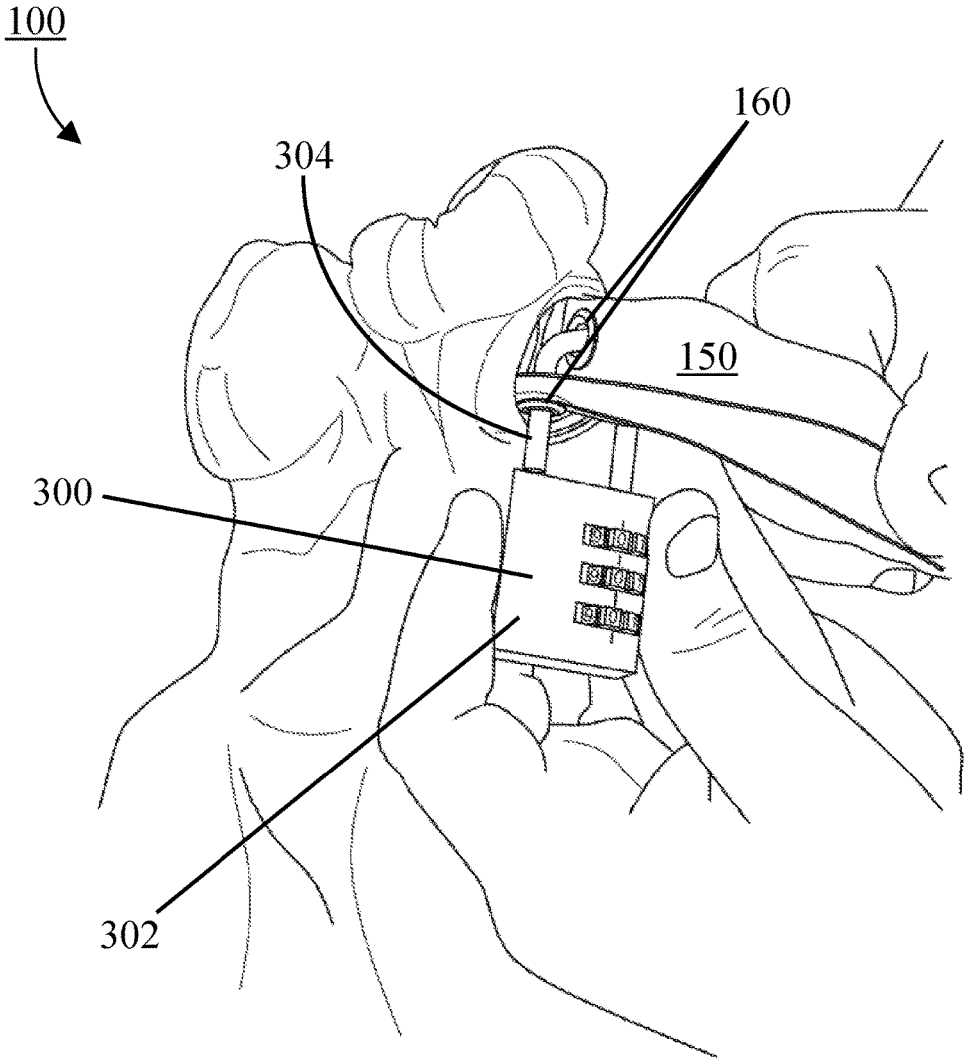
FIG. 5 is a diagram showing engagement of a locking device with the locking strap of the bag of FIG. 1.
Figure 6:
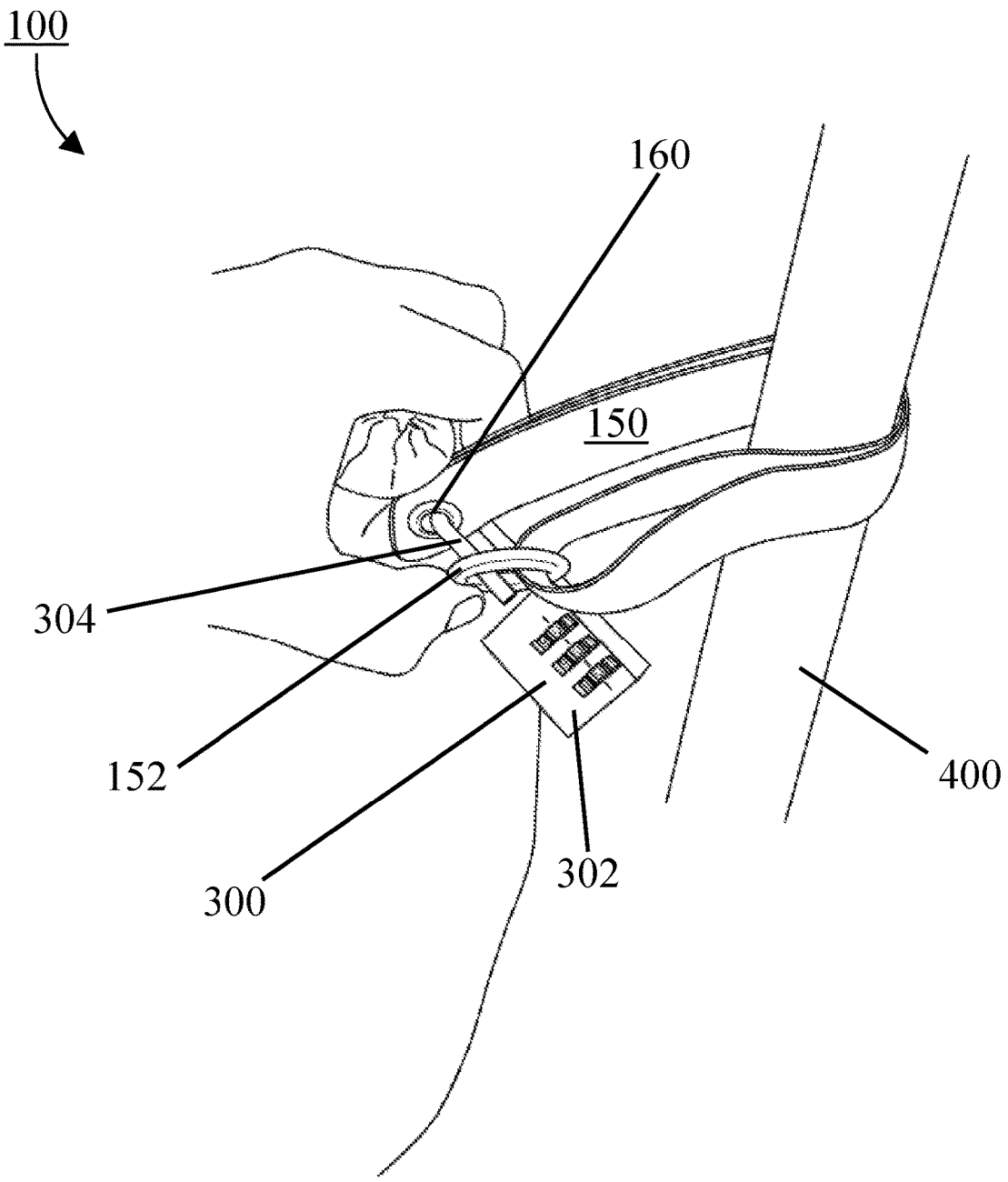
FIG. 6 is a diagram showing the bag of FIG. 1 being secured to a fixed object.
Figure 7:
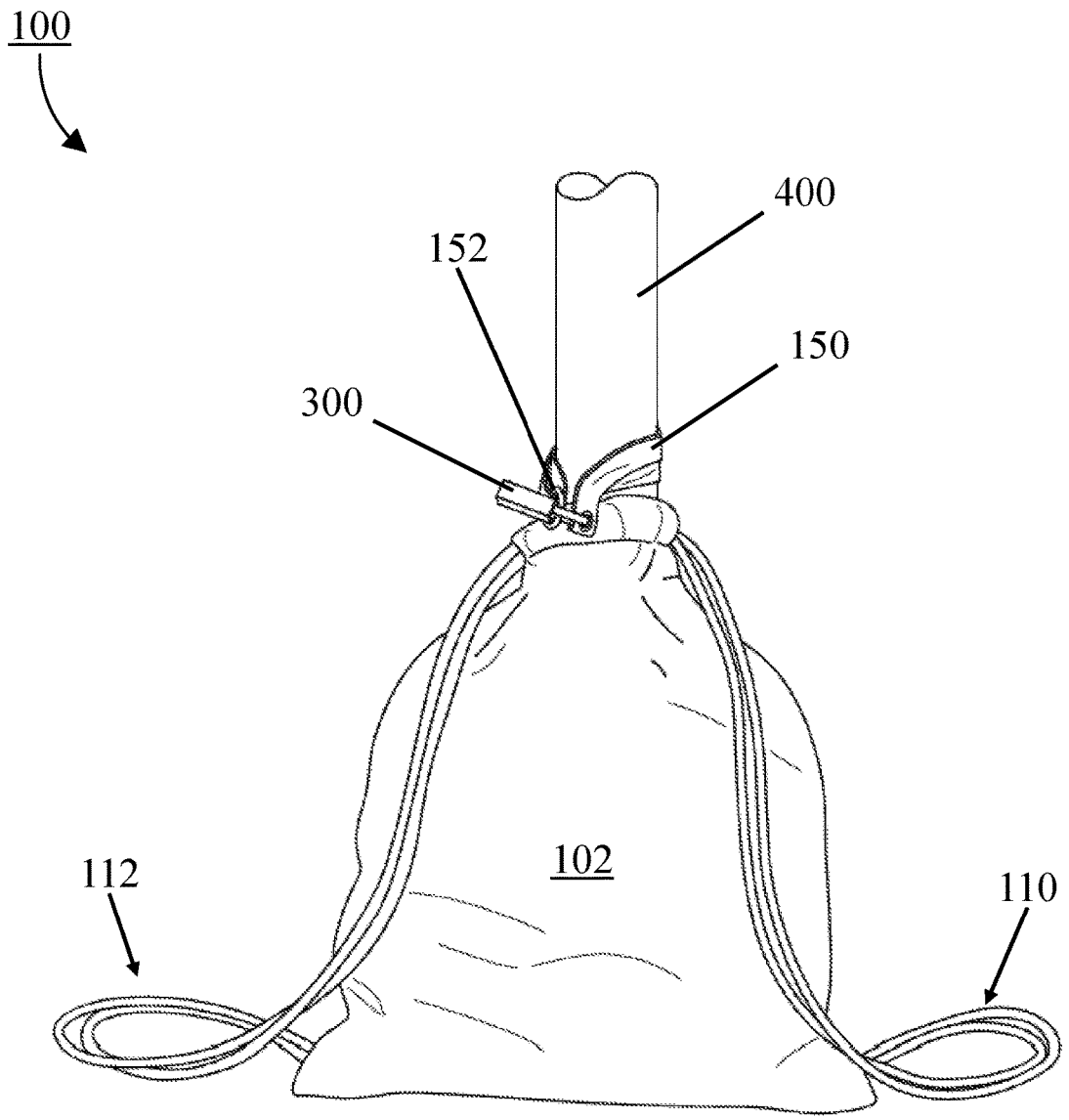
FIG. 7 is a diagram showing the bag of FIG. 1 secured to a fixed object.

As shown in FIGS. 5-6, the locking device 300 is a combination lock having a body 302 and a curved post 304. When the proper combination is input to the locking device 300 (i.e., via dials on the body 302), the post 304 is released from the body 302 and the locking device 300 is unlocked. Conversely, when a wrong combination is input to the locking device 300, the post 304 remains trapped in the body 302 and the locking device 300 stays locked.

As shown in FIG. 1, the bag 100 can include an external pocket 180 for housing or otherwise hiding the locking device 300 when the locking device 300 is not being used. Alternatively, when not being used, the locking device 300 could simply be secured to the locking ring 152 or placed in the internal pocket 140 to prevent loss thereof.

To lock the bag 100, the curved post 304 is released from the body 302 and inserted through both grommets 160 in the locking strap 150. Then, the post 304 is returned to the body 302 and the locking device 300 locked. Because the locking device 300 is too large to fit through the opening 154, the locking strap 150 is prevented from traveling back into the third channel 156 of the bag 100. Consequently, the bag 100 is locked in the closed state (see FIG. 5).

It is also possible to secure the bag 100 in the closed state to a fixed object. The term "fixed object," as used herein, is not intended to mean only objects that are absolutely fixed. Instead, the term encompasses any item not intended to be readily move by an unauthorized person. Typically, the fixed object will not be readily portable by a single person. Thus, fixed objects could include, for example, a beach chair, a bike rack, an automobile steering column, etc.

To secure the bag 100 to a fixed object 400, the locking strap 150 is pulled out of the bag 100, as described above. With the locking ring 152 moved to the end of the locking strap 150, the locking strap 150 is wrapped around the fixed object 400 such that the locking ring is substantially aligned with the grommets 160 (see FIG. 6). In this manner, the curved post 304 of the locking device 300 can be inserted through both grommets 160 and the locking ring 152 of the locking strap 150. Then, the post 304 is returned to the body 302 and the locking device 300 locked. Because the locking strap is secured around the fixed object 400, the bag 100 is effectively secured to the fixed object 400 in the closed state (see FIG. 7).

The above description of specific embodiments has been given by way of example. From the disclosure given, those skilled in the art will not only understand the general inventive concepts and their attendant advantages, but will also find apparent various changes and modifications to the structures and methods disclosed. For example, although the illustrative embodiments disclosed herein utilize grommets 160 in the locking strap 150 as the primary locking means, it is contemplated that other designs and/or configurations of holes or openings in the locking strap 150 could also be used. It is sought, therefore, to cover all such changes and modifications as fall within the spirit and scope of the general inventive concepts, as defined by the appended claims and equivalents thereof.

The invention claimed is:

1. A locking bag comprising:

a tubular body having an open end and a closed end opposite the open end, the tubular body being made from a first cut-resistant material;

a first drawstring on a first side of the tubular body and a second drawstring on a second side of the tubular body, the first and second sides being opposite one another; and a locking strap comprising a pair of grommets each defining a hole through the locking strap, the locking strap being made from a second cut-resistant material;

wherein a portion of the first drawstring surrounds a circumference of the tubular body and is housed in a first channel formed in the tubular body, wherein a portion of the second drawstring surrounds a circumference of the tubular body and is housed in a second channel formed in the tubular body, wherein at least a portion of the locking strap surrounds a circumference of the tubular body and is housed in a third channel formed in the tubular body, and wherein an opening is formed in the tubular body between the first side and the second side, the opening allowing a portion of the locking strap to be removed from the third channel so that the pair of grommets are located outside of the tubular body.

2. The locking bag of claim 1, wherein the first channel is formed adjacent to the open end of the tubular body.

3. The locking bag of claim 1, wherein the second channel is formed adjacent to the open end of the tubular body.

4. The locking bag of claim 1, wherein the third channel is formed adjacent to the open end of the tubular body.

5. The locking bag of claim 1, wherein the first drawstring comprises a pair of ropes, and wherein the second drawstring comprises a pair of ropes.

6. The locking bag of claim 1, wherein the first cut-resistant material is a fabric comprising ultra-high molecular weight polyethylene (UHMWPE) fibers.

7. The locking bag of claim 1, wherein the second cut-resistant material is metal.

8. The locking bag of claim 1, wherein the second cut-resistant material is stainless steel cable.

9. The locking bag of claim 1, wherein the locking strap comprises a tubular nylon cover surrounding a continuous loop formed from stainless steel cable.

10. The locking bag of claim 1, further comprising a locking ring, wherein the locking ring extends around the locking strap and remains outside the third channel.

11. The locking bag of claim 1, further comprising an internal fastener for at least partially closing the open end of the tubular body.

12. The locking bag of claim 11, wherein the internal fastener is a unidirectional fastener having a direction of operation substantially parallel to the open end of the tubular body.

13. The locking bag of claim 11, wherein the internal fastener is a bidirectional fastener having an axis of operation substantially parallel to the open end of the tubular body.

14. A locking bag system comprising a locking bag and a locking device, wherein the locking bag comprises:

a tubular body having an open end and a closed end opposite the open end, the tubular body being made from a first cut-resistant material;

a first drawstring on a first side of the tubular body and a second drawstring on a second side of the tubular body, the first and second sides being opposite one another; and a locking strap comprising a pair of grommets each defining a hole through the locking strap, the locking strap being made from a second cut-resistant material;

wherein a portion of the first drawstring surrounds a circumference of the tubular body and is housed in a first channel formed in the tubular body, wherein a portion of the second drawstring surrounds a circumference of the tubular body and is housed in a second channel formed in the tubular body, wherein at least a portion of the locking strap surrounds a circumference of the tubular body and is housed in a third channel formed in the tubular body, and wherein an opening is formed in the tubular body between the first side and the second side, the opening allowing a portion of the locking strap to be removed from the third channel so that the pair of grommets are located outside of the tubular body; and wherein the locking device comprises:

a lock body;

a lock post; and locking means for selectively releasing the lock post from the lock body and trapping the lock post in the lock body;

wherein the lock post is operable to fit through the pair of grommets in the locking strap when the pair of grommets are located outside the tubular body.

15. The locking bag system of claim 14, wherein the locking means is a key.

16. The locking bag system of claim 14, wherein the locking means is a combination input using a plurality of dials on the lock body that move relative to the lock body.

17. The locking bag system of claim 14, wherein the locking bag further comprises a locking ring that extends around the locking strap and remains outside the third channel, and wherein the lock post is operable to simultaneously fit through the locking ring and the pair of grommets in the locking strap when the pair of grommets are located outside the tubular body.

18. The locking bag system of claim 14, wherein the locking bag further comprises an internal fastener for at least partially closing the open end of the tubular body.

19. The locking bag system of claim 14, wherein the internal fastener is a unidirectional fastener having a direction of operation substantially parallel to the open end of the tubular body.

20. The locking bag system of claim 14, wherein the internal fastener is a bidirectional fastener having an axis of operation substantially parallel to the open end of the tubular body.

* * * * *